US010347441B2

(12) United States Patent
Wu

(10) Patent No.: US 10,347,441 B2
(45) Date of Patent: Jul. 9, 2019

(54) KEYBOARD STRUCTURE

(71) Applicant: Primax Electronics Ltd., Taipei (TW)

(72) Inventor: Ming-Han Wu, Taipei (TW)

(73) Assignee: PRIMAX ELECTRONICS LTD., Taipei (TW)

( * ) Notice: Subject to any disclaimer, the term of this patent is extended or adjusted under 35 U.S.C. 154(b) by 0 days.

(21) Appl. No.: 15/676,250

(22) Filed: Aug. 14, 2017

(65) Prior Publication Data

US 2018/0277318 A1 Sep. 27, 2018

(30) Foreign Application Priority Data

Mar. 24, 2017 (TW) ..... 106109935 A

(51) Int. Cl.

| | |
|---|---|
| ***H01H 13/14*** | (2006.01) |
| ***H01H 13/04*** | (2006.01) |
| ***H01H 13/20*** | (2006.01) |
| ***H01H 3/12*** | (2006.01) |
| ***H01H 13/85*** | (2006.01) |

(52) U.S. Cl.

CPC ..... *H01H 13/14* (2013.01); *H01H 3/125* (2013.01); *H01H 13/04* (2013.01); *H01H 13/20* (2013.01); *H01H 13/85* (2013.01); *H01H 2205/024* (2013.01); *H01H 2215/004* (2013.01); *H01H 2215/006* (2013.01); *H01H 2221/062* (2013.01); *H01H 2227/022* (2013.01); *H01H 2227/028* (2013.01); *H01H 2227/036* (2013.01); *H01H 2233/07* (2013.01)

(58) Field of Classification Search

CPC ..... H01H 13/82; H01H 2213/002; H01H 2215/006; H01H 2215/004; H01H 13/702; H01H 13/83; H01H 3/125; H01H 13/85; H01H 2221/044; H01H 13/7065; H01H 13/14; H01H 13/704; H01H 13/86; H01H 2221/036; H01H 13/52; H01H 2223/003; H01H 3/12

USPC ..... 200/5 A, 341–345

See application file for complete search history.

(56) References Cited

U.S. PATENT DOCUMENTS

2009/0283393 A1* 11/2009 Chen ..... G06F 3/0202 200/314
2015/0237764 A1* 8/2015 Liu ..... G06F 1/203 361/679.46
2018/0012713 A1* 1/2018 Taga ..... H01H 13/14

* cited by examiner

*Primary Examiner* — Ahmed M Saeed
(74) *Attorney, Agent, or Firm* — Kirton McConkie; Evan R. Witt

(57) ABSTRACT

The present invention provides a key structure, including: a key cap, a support board, an elastic element, and a support element. The elastic element includes an elastomer and an elastic piece. The elastomer has a first surface and a second surface, where the first surface includes a first protrusion portion and a second protrusion portion. The support element is connected the key cap and the support board and surrounds the elastic element. When the key cap descends, the first protrusion portion is pressed by the key cap and generates a deformation, so as to form a first pressing stroke, and subsequently, the key cap presses the second protrusion portion to enable the elastic piece to generate a deformation, so as to form a second pressing stroke.

9 Claims, 3 Drawing Sheets

KEYBOARD STRUCTURE

FIELD OF THE INVENTION

The present invention relates to a structure of an input device, and in particular, to a key and an elastomer structure thereof.

BACKGROUND OF THE INVENTION

In the modern society, the use of electronic products has become an indispensable part of the life, and necessities such as eating, clothing, living, traveling, teaching, and entertainment are correlated to electronic products. To facilitate carrying and using of the electronic products, the electronic products are designed to be light and thin. Usually, an electronic product has a key structure. To make the electronic product lighter and thinner, measures are taken to simplify configurations of a support structure and an elastic structure in the key structure, or reduce the heights of the support structure and the elastic structure. In this way, the height of the key is reduced and the volume of the entire keyboard is reduced, but the feel of a pressing stroke of the key may be lost. As a result, a user cannot determine whether pressing of the key is completed or uncomfortable pressing feel is generated, and therefore the user feels inconvenient.

To maintain a good feel of pressing of the key, US patent publication no. US20110203912 discloses a key structure in which an elastomer (Elastomeric Dome) is used together with a metal elastic piece (Metal Dome). When a key is pressed, the elastomer is first touched and pressed to deform, and subsequently, the metal elastic piece is touched and pressed, so as to maintain the pressing feel of the key. However, in the earlier patent, a protrusion structure at a lower surface of a key cap directly presses the metal elastic piece. In this way, noises may be generated during pressing. Moreover, both the key cap and the metal elastic piece are rigid structures, resulting in a rigid pressing feel. In addition, in the prior art, a key is usually mounted by first adhering a metal elastic piece onto a thin film switch and then disposing an elastomer on the metal elastic piece. In the assembly process, by the mounting method, the protrusion structure at the lower surface of the key cap may not be able to actually press the metal elastic piece due to an offset of a center point between the elastomer and the metal elastic piece, resulting in a failure in the key function or a change in the pressing stroke of the keyboard.

Therefore, how to maintain the pressing feel and comfort of a key and avoid an offset in mounting of an elastomer and an elastic piece of the key when the height of the key structure is reduced is a technical issue to be resolved by the present invention.

SUMMARY OF THE INVENTION

A main objective of the present invention is providing a key structure that has a decreased entire height and a stable pressing stroke, and has an elastic element capable of avoiding a pressing offset.

To achieve the foregoing objective, the present invention provides a key structure, including:

a key cap;

a support board;

an elastic element including an elastomer and an elastic piece, where the elastomer has a first surface and a second surface, and the first surface includes a first protrusion portion and a second protrusion portion; and a support element connected to the key cap and the support board and surrounding the elastic element, where when the key cap descends, the first protrusion portion is pressed by the key cap and generates a deformation, so as to form a first pressing stroke, and subsequently, the key cap presses the second protrusion portion to enable the elastic piece to generate a deformation, so as to form a second pressing stroke.

In the foregoing preferred embodiment, the elastic piece has a third surface and a fourth surface, and the third surface of the elastic piece is adjacent to the second surface of the elastomer.

In the foregoing preferred embodiment, when the elastic piece is pressed by the second protrusion portion to generate a deformation, the fourth surface is configured to contact a switch to generate a key signal.

In the foregoing preferred embodiment, the switch is disposed at a surface of a thin film layer.

In the foregoing preferred embodiment, the thin film layer is disposed on the support board.

In the foregoing preferred embodiment, the vertical height of the second protrusion portion is equal to that of the first protrusion portion.

In the foregoing preferred embodiment, the vertical height of the second protrusion portion is less than that of the first protrusion portion.

In the foregoing preferred embodiment, the first protrusion portion is a coronal protrusion portion and surrounds the second protrusion portion.

In the foregoing preferred embodiment, the coronal protrusion portion is provided with at least one notch.

In the foregoing preferred embodiment, the material of the elastomer is rubber or silicon.

In the foregoing preferred embodiment, the support element includes a first support and a second support.

DETAILED DESCRIPTION OF THE PREFERRED EMBODIMENT

More detailed descriptions are made with reference to the examples of the embodiments and the accompanying drawings, to make advantages and features of the present invention and the method to implement the present invention easier to understand. However, the present invention may be implemented in different forms and it should not be understood that the present invention can be implemented only by using the embodiments described herein. On the contrary, for those ordinarily skilled in the art, the provided embodiments will make the disclosure more apparent and comprehensive and completely convey the scope of the present invention.

Figure 1:
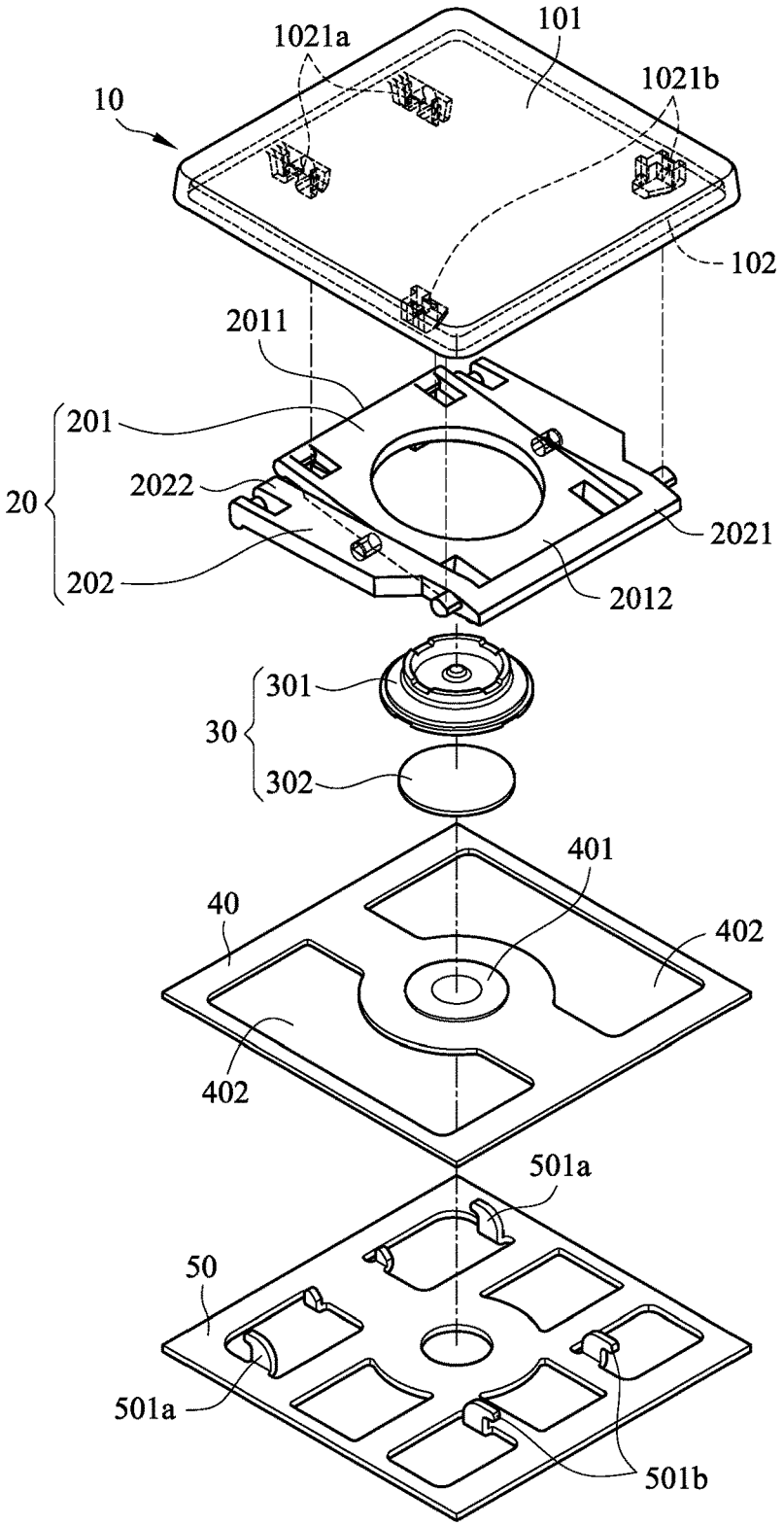
FIG. 1 is a stereoscopic schematic diagram of a key structure according to the present invention.

First, referring to FIG. 1, FIG. 1 is a stereoscopic schematic diagram of a key structure according to the present invention. In FIG. 1, the key structure of the present invention includes: a key cap 10, a support element 20, an elastic element 30, a thin film layer 40, and a support board 50. The elastic element 30 is disposed below the key cap 10, and the support element 20 surrounds the elastic element 30 and is connected to the key cap 10 and the support board 50.

Still referring to FIG. 1, the key cap 10 has an upper surface 101 and a lower surface 102. The lower surface 102 has first bonding portions 1021*a* and 1021*b*. The support element 20 includes a first support 201 and a second support 202. The first support 201 has a first end 2011 and a second end 2012, and the second support 202 also has a first end 2021 and a second end 2022. The elastic element 30 includes an elastomer 301 and an elastic piece 302. The thin film layer 40 includes a switch 401 and an opening 402. The support board 50 has second bonding portions 501*a* and 501*b*. During key assembly, the first support 201 and the second support 202 may be pivotally connected to each other by means of a pivot shaft (not shown). The first end 2011 of the first support 201 is pivotally connected to the first bonding portion 1021*a* of the key cap 10. The second end 2012 of the first support 201 is pivotally connected to the second bonding portion 501*b* of the support board 50. The first end 2021 of the second support 202 is pivotally connected to the first bonding portion 1021*b* of the key cap 10. The second end 2022 of the second support 202 is pivotally connected to the second bonding portion 501*a* of the support board 50. In this way, the first support 201 and the second support 202 are rotationally connected to the key cap 10 and the support board 50, so as to drive and guide the key cap 10 to move upward and downward with respect to the support board 50. Although the present invention merely provides an implementation of a scissor foot structure of the support element 20, in actual applications, the support element 20 may be replaced with another support element having a similar function, for example, a V-shaped connecting rod structure, A-shaped connecting rod structure, or two parallel connecting rod structures, and the present invention is not limited to the implementation provided herein.

The thin film layer 40 is disposed on the support board 50, and includes the switch 401 and the opening 402. The second bonding portions 501*a* and 501*b* of the support board 50 pass through the opening 402 of the thin film layer 40, so as to be pivotally connected to the second end 2012 of the first support 201 and the second end 2022 of the second support 202. The elastic element 30 is disposed on the switch 401, and includes the elastomer 301 and the elastic piece 302. When the key cap 10 is pressed to descend, the elastic element 30 generates a deformation to form at least one pressing stroke, and contact the switch 401 by means of the elastic piece 302, so as to generate a key signal. When the key cap 10 is not pressed, the elastic element 30 also provides an upward elastic restoring force for the key cap 10, so as to raise and reset the key cap 10.

Figure 2:
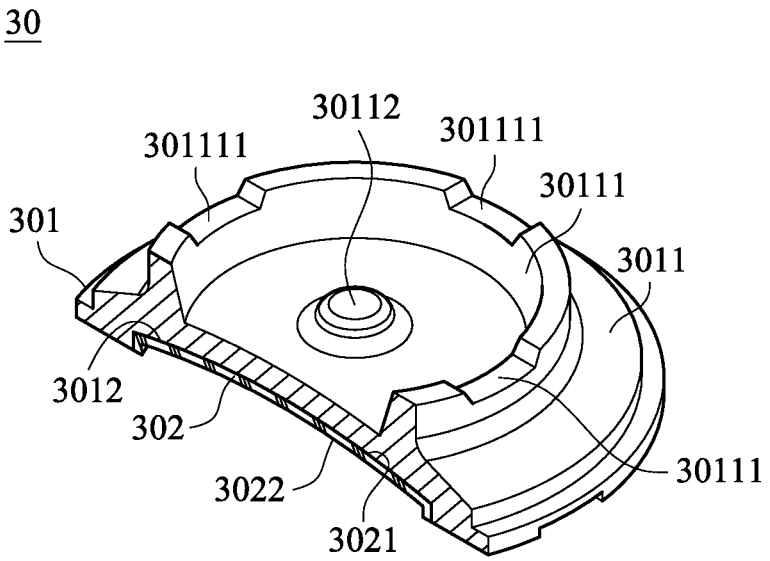
FIG. 2 is a cross-sectional view of an elastomer structure according to the present invention.

Referring to FIG. 1 and FIG. 2, FIG. 2 is a cross-sectional view of an elastomer structure according to the present invention. The elastomer 301 of the elastic element 30 has a first surface 3011 and a second surface 3012. The first surface 3011 has a first protrusion portion 30111 and a second protrusion portion 30112. The first protrusion portion 30111 may be a coronal protrusion portion and surrounds the second protrusion portion 30112. The second protrusion portion 30112 may be a conductive column, and the vertical height of the second protrusion portion 30112 may be equal to or less than that of the first protrusion portion 30111. In addition, the first protrusion portion 30111 is provided with at least one notch 301111. The notch 301111 has a function of enabling the air to circulate. For example, when the lower surface 102 of the key cap 10 presses the first protrusion portion 30111, the notch 301111 avoids a negative pressure state caused by exhaust of air between the lower surface 102 and the first protrusion portion 30111. In this way, a case in which the key cannot operate normally because the elastic element 30 is absorbed at the lower surface 102 of the key cap 10 may be avoided. Although the present invention merely provides the implementation in which the notch 301111 is used for air circulation, in actual applications, the generation of the negative pressure state may be avoided by changing the appearance and the shape of the first protrusion portion 30111, or the air may be enabled to circulate by providing an aperture on the elastomer 301 or the key cap 10, and the present invention is not limited to the implementation of the notch 301111. The material of the elastomer 301 of the present invention may be rubber or silicon.

Still referring to FIG. 2, the elastic piece 302 has a third surface 3021 and a fourth surface 3022. The third surface 3021 is adjacent and attached to the second surface 3012 of the elastomer 301. In this way, when the second protrusion portion 30112 of the elastomer 301 is pressed, the elastic piece 302 is enabled to generate a deformation, so that the fourth surface 3022 contacts the switch 401 to generate a key signal. Although the present invention merely provides an implementation in which the second protrusion portion 30112 is disposed on the first surface 3011 of the elastomer 301, in actual applications, the second protrusion portion may also be disposed on the lower surface 102 of the key cap 10, and the present invention is not limited to the implementation provided herein. The elastic piece 302 of the present invention may be made of a metal or a conductive material. In addition, the elastic piece 302 of the elastic element 30 is pre-adhered into the elastomer 301. Therefore, when the elastic element 30 is disposed on the switch 401, an offset in mounting of the elastomer and the elastic piece can be effectively avoided.

Figure 3A:
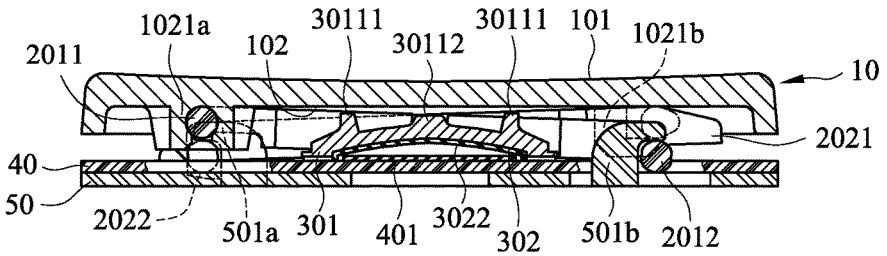
FIG. 3A and FIG. 3B are schematic diagrams of key operations according to the present invention.
Figure 3B:
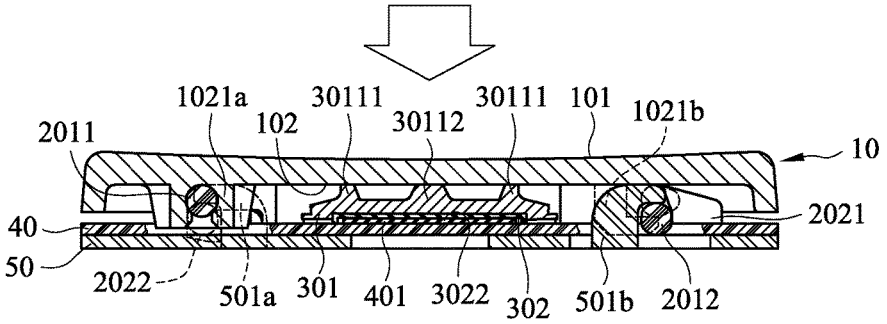

Referring to FIG. 3A and FIG. 3B, FIG. 3A and FIG. 3B are schematic diagrams of key operations according to the present invention. In FIG. 3A, the vertical height of the second protrusion portion 30112 is less than that of the first protrusion portion 30111. In FIG. 3B, when the upper surface 101 of the key cap 10 is pressed and the key cap 10 descends, the lower surface 102 of the key cap 10 first presses the first protrusion portion 30111 and enables the first protrusion portion 30111 to generate a deformation, thereby forming a first pressing stroke by means of the deformation of the first protrusion portion 30111. Subsequently, the lower surface 102 of the key cap 10 that keeps descending presses the second protrusion portion 30112, so as to enable an elastic piece 302 to generate a deformation, thereby forming a second pressing stroke by means of the deformation of the elastic piece 302. The present invention generates two stages of pressing stroke by means of deformations of the first protrusion portion 30111 and the elastic piece 302. For example, if the vertical height of the first protrusion portion 30111 is equal or close to that of the second protrusion portion 30112, when a user presses the key cap 10, segmentation of the first pressing stroke and the second pressing stroke cannot be sensed. That is, the two stages of pressing stroke cannot be significantly sensed. If the vertical height of the second protrusion portion 30112 is less than that of the first protrusion portion 30111, when the user presses the key cap 10, the lower surface 102 of the key cap 10 presses the first protrusion portion 30111, and only after a relatively long time of deformation in the first protrusion portion 30111, the lower surface 102 of the key cap 10 presses the second protrusion portion 30112, to drive the elastic piece 302 to generate a deformation. In this way, the user may significantly sense the two stages of pressing stroke of the first pressing stroke and the second pressing stroke.

By adjusting the vertical heights of the first protrusion portion 30111 and the second protrusion portion 30112 of the elastomer 301, various pressing feel may be generated. In this way, the key structure provided in the present invention may be applied to various electronic products having a keyboard.

Compared with the prior art, the key cap of the key structure provided in the present invention presses the elastomer to enable the elastic piece to generate a deformation instead of directly pressing the elastic piece, so that the rigid pressing feel and problems generated by noises can be alleviated. In another aspect, when the height of the key structure is reduced, the two stages of pressing stroke are formed by means of the first protrusion portion and the second protrusion portion of the elastomer together with the elastic piece, thereby maintaining a stable pressing feel of the key. Further, different pressing feel may be generated by adjusting the vertical heights of the first protrusion portion and the second protrusion portion of the elastomer, so that the key structure provided in the present invention can be applied to various electronic products having a keyboard. In addition, because the elastic piece is pre-adhered into the elastomer, during a process of manufacturing a keyboard, an offset in mounting of the elastomer and the elastic piece can be effectively avoided, so as to improve the yield of the electronic product manufacturing. Therefore, the present invention actually is a creation having great industrial value.

Any modification made to the present invention by persons skilled in the art by means of technical measures shall fall within the protection scope of the present invention.

What is claimed is:

1. A key structure, comprising:

a key cap;

a support board;

an elastic element comprising an elastomer and an elastic piece, wherein the elastomer has a first surface and a second surface, and the first surface comprises a first protrusion portion and a second protrusion portion, wherein the elastic piece has a third surface and a fourth surface, and the third surface of the elastic piece is adjacent to the second surface of the elastomer, wherein when the elastic piece is pressed by the second protrusion portion to generate a deformation, the fourth surface is configured to contact a switch to generate a key signal; and a support element connected to the key cap and the support board and surrounding the elastic element, wherein when the key cap descends, the first protrusion portion is pressed by the key cap and generates a deformation, so as to form a first pressing stroke, and subsequently, the key cap presses the second protrusion portion to enable the elastic piece to generate a deformation, so as to form a second pressing stroke.

2. The key structure according to claim 1, wherein the switch is disposed at a surface of a thin film layer.

3. The key structure according to claim 2, wherein the thin film layer is disposed on the support board.

4. The key structure according to claim 1, wherein the vertical height of the second protrusion portion is equal to that of the first protrusion portion.

5. The key structure according to claim 1, wherein the vertical height of the second protrusion portion is less than that of the first protrusion portion.

6. The key structure according to claim 1, wherein the first protrusion portion is a coronal protrusion portion and surrounds the second protrusion portion.

7. The key structure according to claim 6, wherein the coronal protrusion portion is provided with at least one notch.

8. The key structure according to claim 1, wherein the material of the elastomer is rubber or silicon.

9. The key structure according to claim 1, wherein the support element comprises a first support and a second support.

* * * * *